United States Patent [19]

Auckenthaler

[11] 3,973,474

[45] Aug. 10, 1976

[54] APPARATUS FOR MAKING BAGS

[75] Inventor: Robert Auckenthaler, Schaffhausen, Switzerland

[73] Assignee: SIG Schweizerische Industrie-Gesellschaft, Neuhausen am Rheinfall, Switzerland

[22] Filed: Feb. 12, 1975

[21] Appl. No.: 549,211

[30] Foreign Application Priority Data

Feb. 13, 1974 Switzerland ..... 1995/74

[52] U.S. Cl. ..... 93/18; 93/12 R; 93/27; 93/36.01

[51] Int. Cl.[2] ..... B31B 37/26

[58] Field of Search ..... 93/14–20, 93/8 R, 12 R, 32, 35 SB, 35 R, 36.01, 36.8, 27

[56] References Cited

UNITED STATES PATENTS

| | | | |
|---|---|---|---|
| 2,179,685 | 11/1939 | Chalmers | 93/12 R X |
| 3,201,914 | 8/1965 | Lohse et al. | 93/18 X |
| 3,263,391 | 8/1966 | Wallsten | 93/35 SB |
| 3,774,509 | 11/1973 | Heinzer | 93/35 SB X |

*Primary Examiner*—James F. Coan
*Attorney, Agent, or Firm*—Spencer & Kaye

[57] ABSTRACT

In bag making, a web of sealable material is wrapped around a forming tube of rectangular cross section, the adjoining edges of the web are bonded to one another to form a hose, a transversal seam is provided to form a hose bottom continuing in ears, drawing the hose off the forming tube in the direction of its length by grasping solely the hose ears and transversely severing the hose below the forming tube for obtaining an individual bag.

2 Claims, 10 Drawing Figures

APPARATUS FOR MAKING BAGS

BACKGROUND OF THE INVENTION

This invention relates to a method and apparatus for the manufacture of bags, wherein a hose made of sealable foil material is cyclically withdrawn from a forming tube of rectangular cross section to an extent corresponding to the length of the bag, then the withdrawn hose portion is spread apart at one location and is provided with a transverse seam for forming the bag bottom in such a manner that the bottom runs into ears extending from the narrow sides of the hose. Subsequently, the hose portion drawn from the forming tube is severed to obtain an individual bag. An apparatus for automatically performing the above-outlined method is disclosed in Swiss Pat. No. 542,701. For the purpose of drawing the hose each time by a bag length from the forming tube, according to this patent there are formed small folds in the hose at the lower ends of the two wide sides of the hose along the edge of the bag bottom. These small folds are grasped by a dual clamp. These edge folds give the bottom, and thus the entire bag, a highly desirable form stability. Such edge folds, however, also have disadvantages. If bags manufactured in the above-outlined manner are, subsequent to their filling with the goods, closed vacuum-tight, frequently the vacuum in the bag cannot be maintained for a sufficiently long period. It was found that this drawback is caused by very small, often invisible ruptures or punctures in the foil material. These damages may be caused during the formation of the edge folds or when they are grasped by the dual clamp. It is a further disadvantage of the edge folds that complex mechanisms are needed for forming the same.

SUMMARY OF THE INVENTION

It is an object of the invention to provide an improved method of the above type from which the discussed disadvantages are eliminated.

These and other objects to become apparent as the specification progresses, are accomplished by the invention, according to which, briefly stated, there is provided a bag-making method including the step of grasping the above-mentioned ears, rather than the small edge folds, for drawing the hose off the forming tube.

The apparatus for automatically performing the above-outlined method comprises a dual clamp which is shiftable in the longitudinal direction of the forming tube and which has two pairs of jaws. The dual clamp draws the hose, provided with the bag bottom, into a container which is aligned with the forming tube and which is advanced intermittently by a stepping device. The jaw pairs of the dual clamp are disposed adjacent the one and the other narrow side of the forming tube.

The invention further relates to the bag structure itself, made according to the novel method outlined above.

DESCRIPTION OF THE PREFERRED EMBODIMENTS

Figure 1:
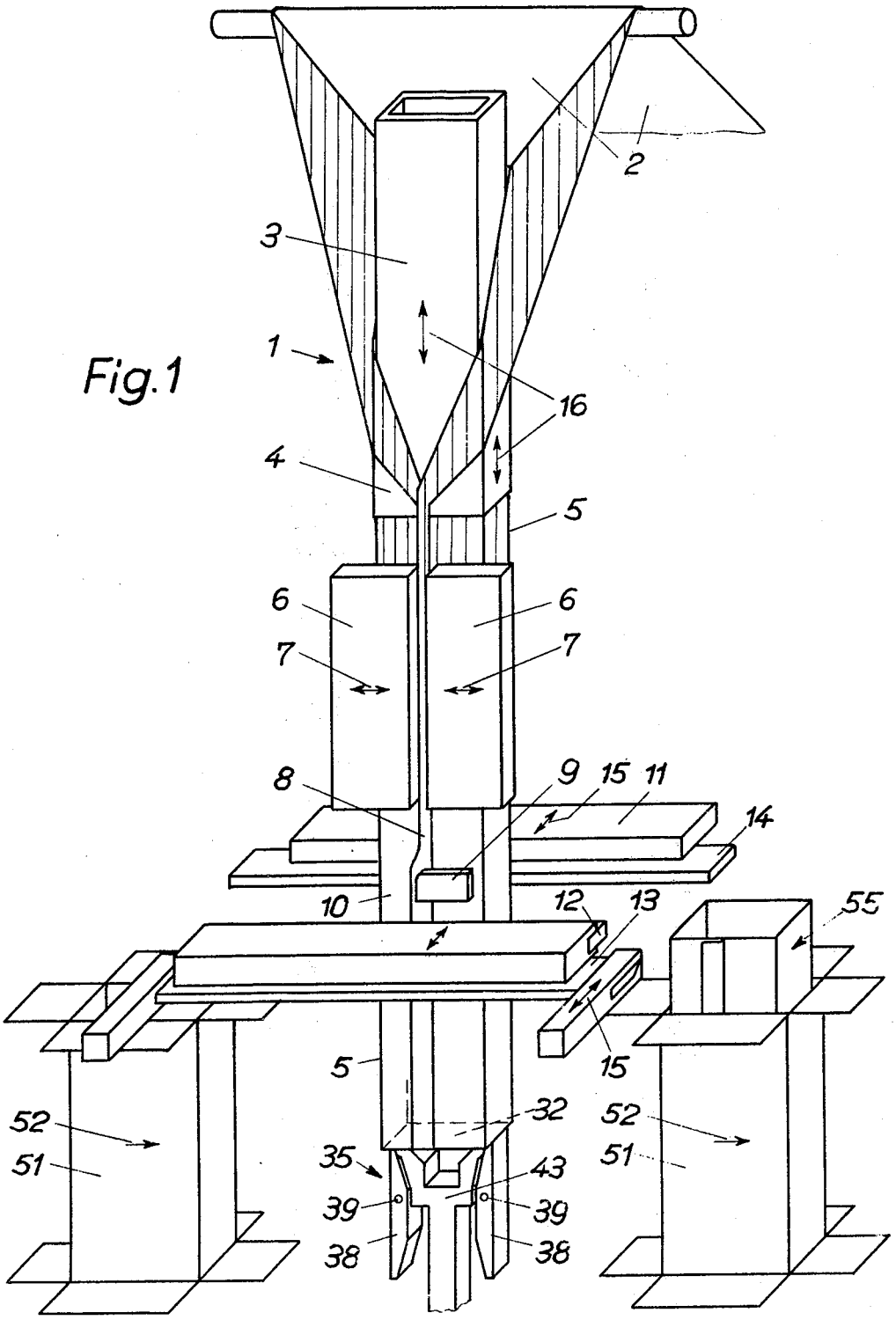
FIG. 1 is a schematic perspective view of a preferred emobdiment of the invention.

Turning now to FIG. 1, there is illustrated a conventional hose forming device 1 which draws a web 2, made of a foil-like, sealable (preferably weldable), synthetic material, from a supply roll, not shown. The device 1 has a vertically oriented forming tube 3 of rectangular cross section which is surrounded by a folder shroud 4. The web 2 passes between the forming tube 3 and the folder shroud 4 at which time it conforms about the forming tube 3, whereby a hose 5 is obtained. For a better illustration as to how the hose is formed, some portions of the web 2 as well as the hose 5 are provided with vertical shade lines. The device 1 further includes two juxtapositioned, electrically heatable welding shoes 6 which are movable towards and away from one another in the direction indicated by the double-headed arrows 7 and which serve to bond together the outwardly folded longitudinal edges of the web 2 by means of a longitudinal seam 8. The latter is, with the aid of a seam folder 9, laid flat against the large face 10 of the hose 5. Below the seam folder 9 there are disposed a heating shoe 11 with an associated counter member 12 and a knife 13 with an associated counter member 14 which all are movable towards and away from one another in the direction of the double-headed arrows 15. The purpose of this arrangement is to unite the two large sides 10 of the hose 5 by means of a transversal seam and to sever the hose 5 below the transversal seam. The forming tube 3 and the folder shroud 4 are displaceable in the longitudinal direction as indicated by the double-headed arrow 16 (also shown in FIGS. 2 and 3).

Figure 4:
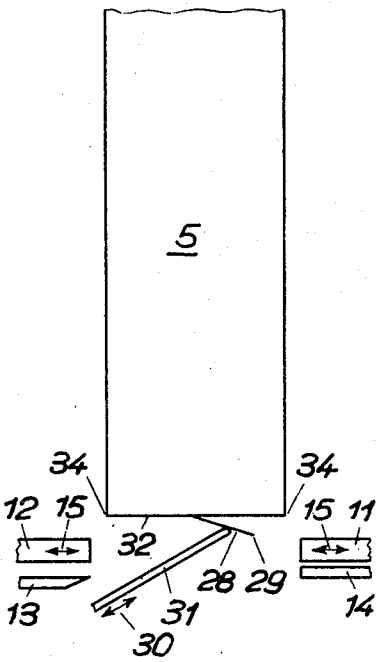
FIG. 4 is a schematic side elevational view taken in the direction of arrow IV of FIG. 3.
Figure 3:
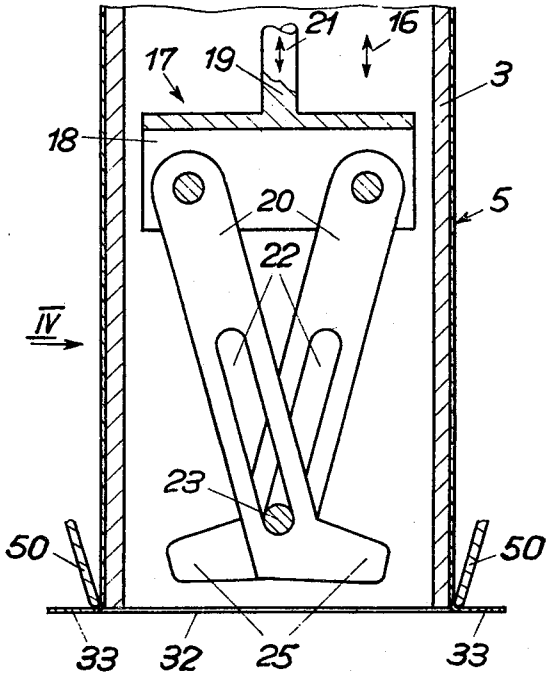
FIGS. 2 and 3 are longitudinal sectional views of a part illustrated in FIG. 1, depicting two different operational positions.
Figure 2:
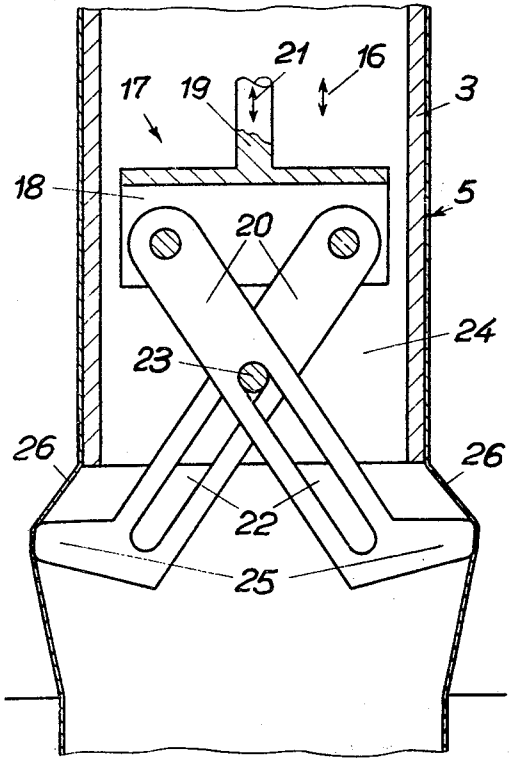

Turning now to FIGS. 2 and 3, within the forming tube 3 there is provided an expanding device 17 which has two crossing expander arms 20 articulated to a head 18 of an actuating ram 19. The ram 19 which, as indicated by the double-headed arrow 21, can be reciprocated vertically, projects outwardly from the top of the forming tube 3 and is connected to a ram drive, not shown. The arms 20 have longitudinal slots 22 through which there extends, at the crossing point, a horizontal pin 23 which is affixed to, and extends from, one of the large sides 24 of the forming tube 3. The angled lower ends 25 of the arms 20 spread apart, in their expanding position of the device 17 illustrated in FIG. 2, the small sides 26 of the hose 5. The forming tube 3 is drawn upwardly prior to expanding the elastically bending small sides 26. Thereafter, the heating shoe 11 and the knife 13 are actuated together with their associated counter members 12 and 14, respectively, so that the earlier-mentioned transversal seam 28 (FIG. 4) is formed and hose 5 is severed under the seam 28 at 29. In FIG. 4, there is depicted a somewhat later moment in which the transversal seam 28 is laid flat against the bottom 32 by means of a seam folder 31 which reciprocates in the direction 49 of the double-headed arrow 30.

In FIG. 3 the expander 17 is shown in its position of rest, that is, in an inwardly pivoted position of the expander arms 20. The forming tube 3 is, subsequent to the formation of the bottom 32, lowered and the ram 19 is drawn upwardly. The bottom 32 runs, by virtue of the manner of its formation, into two ears 33 which extend outwardly from the two small sides 26 of the bag and which are formed by those portions of the small sides 26 which are expanded outwardly and which are engaged by the ends of the heating shoe 11 and the counter member 12. The ears 33 are preferably reinforced by an ear pressing device (not illustrated) of known structure.

As mentioned earlier, in the known apparatus disclosed in Swiss Pat. No. 542,701, the hose 5, provided with the bottom 32, is drawn downwardly by a dual clamp which grasps the bottom edge folds made at the long bottom edges, that is, along the edges designated at 34 in FIG. 4. The earlier-discussed disadvantages resulting from such edge folds are eliminated by grasping, according to the invention, the hose 5 solely at the ears 33 of the bottom 32 and pulling the hose downward. For this purpose there is provided a dual clamp 35 which is illustrated in detail in FIGS. 5–7. The dual clamp 35 has two symmetrically arranged jaw pairs, each formed of two jaws 36 and 37. The one and the other jaw pairs are respectively situated at all times in the close vicinity of the planes containing the one and the other small sides of the forming tube 3.

The two outer jaws 37 are formed by the upper arms of two levers 38 which are articulated at 39 at each end of a transversal bar 40. The latter forms part of a clamp head 43 vertically reciprocated by means of a driving rod 41 in the direction of the double-headed arrow 42. The clamp head 43 has two upwardly extending arms 44 which form the inner jaws 36. The jaws 36, 37 of each clamp jaw pair are maintained in an open position by means of compression springs 45 (See FIGS. 5 and 6), as long as a control head 47, which is vertically reciprocated in the direction of the double-headed arrow 46, does not urge outwardly the cam faces 48 of the lower arms of the lever 38 by a relative upward motion with respect to the clamp head 43 (see FIG. 7).

Adjacent the lower end of the narrow sides of the forming tube 3 there are provided strip members 50 which will be hereinafter designated as "ear folders" and which are obliquely movable upwardly and downwardly in the direction of the double-headed arrow 49.

In FIG. 1 there are further illustrated two cardboard boxes 51 which are open at the top and the bottom and which, by means of a device such as a stepping conveyor, are intermittently advanced in a known manner in the direction of the arrow 52 underneath the hose forming device 1. Upon each stepwise advance, a box 51 is brought into alignment with the forming tube 3 and remains stationary for a short period. It is noted that in FIG. 1, there is shown no box 51 in this aligned position — hereinafter designated as "position of insertion" — so as not to obstruct the view of the dual clamp 35 and the lower terminus of the hose 5, provided with the bottom 32.

Figures 5, 6, 7, 8, 9:
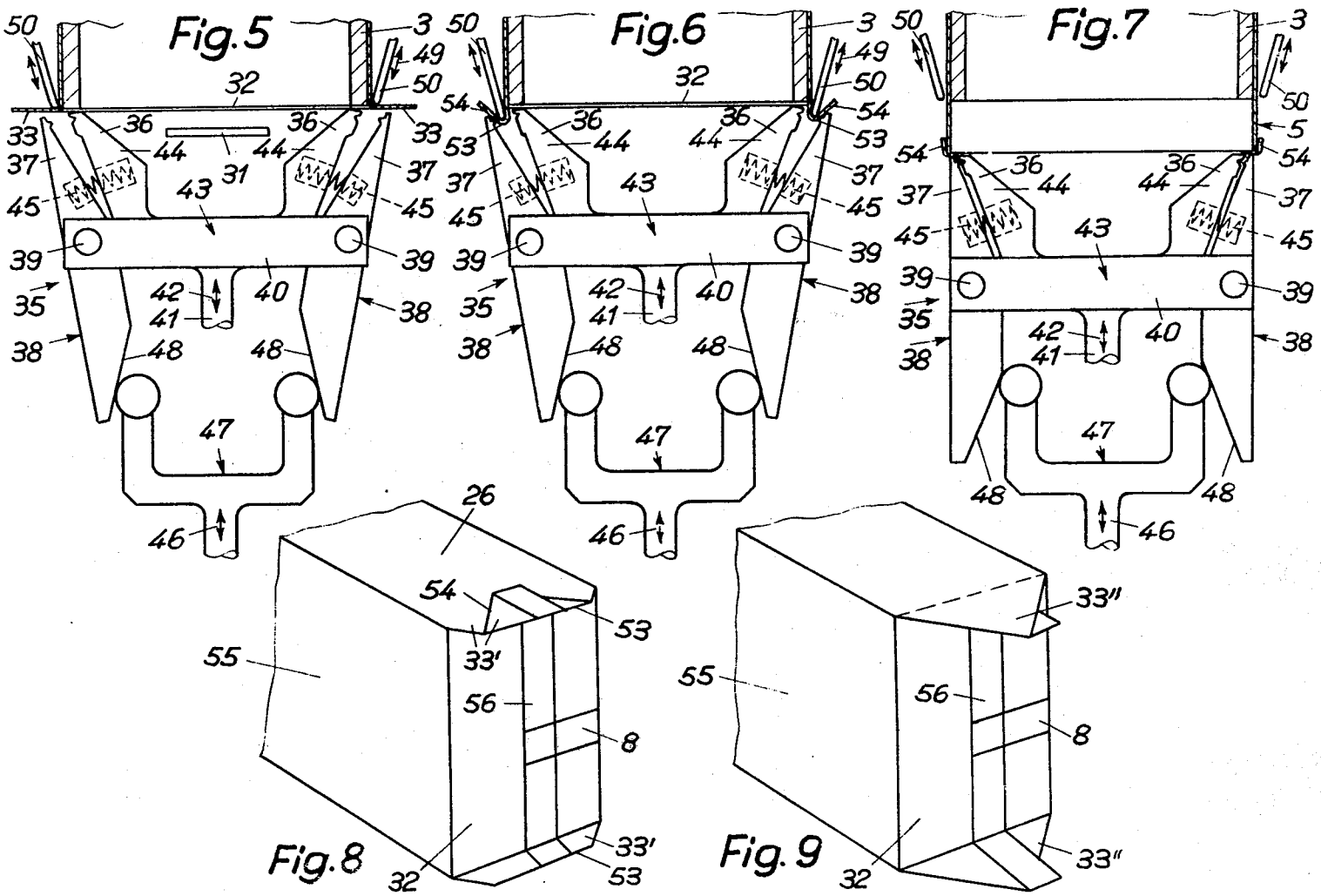
FIGS. 5, 6, and 7 are front elevational views of a component shown in FIG. 1, illustrated in three different operational positions.
FIG. 8 is a perspective view of the bottom part of a bag manufactured according to the invention.
FIG. 9 is a perspective view of a modified bottom part of a bag made according to the invention.

After the bottom 32 has been formed in the above-outlined manner, the dual clamp 35 and the control head 47 disposed therebelow are, from below, pushed through the open bottom of the box 51 located in the position of insertion, until the dual clamp 35 is disposed immediately under the bottom 32 and the forming tube 3 as illustrated in FIG. 5. Thereupon, the ear folders 50 are moved obliquely downward, whereby the ear folders 50 tuck the ears 33, while forming a fold 53, into the open jaw pairs 36, 37 as illustrated in FIG. 6. By moving upwardly the control head 47, the jaws 36, 37 are closed and they thus firmly grasp the folded ears 33. Thereupon the dual clamp 35 and the control head 47 which maintains the jaws 36, 37 in a closed position, are together moved downwardly. As a result, the lower end of the hose 5 is drawn downwardly into the box 51. The ends 54 of the ears 33 are, at the same time, positioned flat against the small sides 26 of the hose 5. In FIG. 7 there is shown the position of the dual clamp 35 in which the hose 5 has already been drawn slightly from the forming tube 3 and the ear folders 50 have already been moved upwardly. When the bottom 32 reaches the lower end of the box 51, the dual clamp 35 is opened. After the heating shoe 11, together with the counter member 12, has formed a new transverse seam and the knife 13, in cooperation with its counter member 14, has severed the hose 5 underneath the transversal seam, the boxes 51 are advanced by one step. Thus, in the box 51 leaving the position of insertion, there is disposed a hose bag 55, the upper, open end of which slightly projects beyond the upper edges of the box 51. Thereafter the box 51, together with the open bag 55, is advanced to a filling apparatus which charges the bag with goods, for example, ground coffee. Subsequently, the box 51, with a still open bag 55, is advanced to a closing apparatus in which the bag 55 is closed, for example, by sealing after vacuumizing. The upper, empty terminus of the bag 55 is thereafter tucked into the box 51, whereupon the latter is closed at both ends. If the merchandise in the bag 55 is to be marketed without the cardboard box 51, instead of boxes 51 there is used a simple sleeve of a rectangular section from which the bag 55, subsequent to its travel through the filing and closing stations, is removed.

Turning now to FIG. 8, there is particularly well shown the bottom 32 of the bag 55 made according to the above-described method. The folded ears 33' project downwardly away from the bag beyond the bottom 32 approximately to the extent of the depth of their penetration into the jaws 36, 37. The longitudinal seam 8 of the hose and the transverse seam 56 formed for obtaining the bottom 32 are also well visible in FIG. 8.

FIG. 9 shows a modification of the bottom 32 obtained when the ears 33 are not pushed into the open jaws 36, 37 (as shown in FIG. 6), but, by means of the ear folders 50, are bent approximately 90° downwardly without folding, to lie, at least approximately, in the plane of the respective small sides of the forming tube 3. Only thereafter is the dual clamp 35 moved upwardly to grasp the downwardly bent ears. The latter then, as a whole, project downwardly beyond the bottom 32 as indicated at 33''. It is to be understood that before closing the box 51, the ears 33'' are folded onto the bottom 32.

By practicing the above-discussed method, the danger of damaging the web material during the formation of edge folds or during grasping and pulling the hose by the dual clamp in accordance with the prior art is eliminated. Adjoining sheet portions are, in the ears 33, connected to one another in such a firm manner by means of the relatively wide transverse seam 56 that the possibility of damaging the material is practically excluded. In case the filled bag is closed after application of vacuum, it is thus ensured that the vacuum is maintained for a practically unlimited period, for example, several years. It is noted that for performing the method according to the invention, it is not necessary to use the described dual clamp, since, in principle, the ears 33 may be grasped by hand to pull the hose 5 manually. It follows that neither the box 51 nor a corresponding sleeve of rectangular section are necessary. It has to be added in this connection that a non-automatic embodiment for practicing the invention appears to have little practical significance. It is further added that the web 2 does not need to consist of a weldable material; it is sufficient if it is warm-sealable or cold-sealable. Welding here is considered as a particular form of warm-sealing.

It will be understood that the above description of the present invention is susceptible to various modifications, changes and adaptations, and the same are intended to be comprehended within the meaning and range of equivalents of the appended claims.

Figure 10:
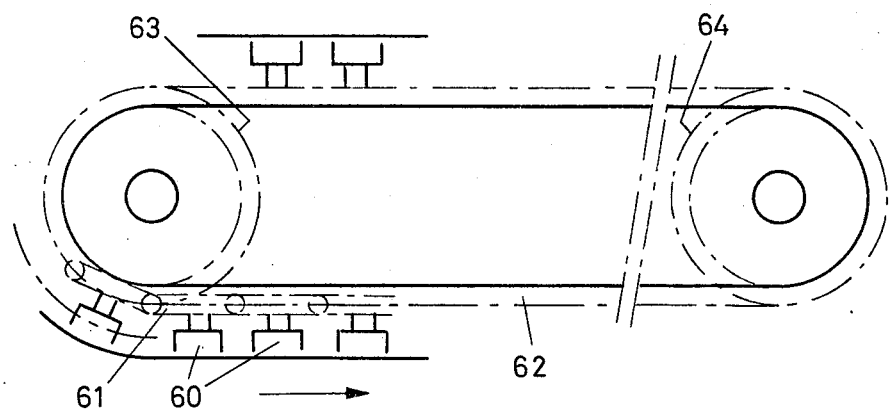
FIG. 10 is a schematic side elevational view of the stepping conveyor.

The stepping conveyor (FIG. 10) comprises U-shaped holding means 60 for grasping the boxes 51. The holding means 60 are attached at equal intervals to the links 61 of a continuous chain 62 moving step by step in a horizontal plane over the two gear wheels 63 and 64.

A Geneva gear provides in a known manner the stepping drive of the drive gear wheel 63 and thus the chain 62.

I claim:

1. In an apparatus for making bags, including a forming tube of rectangular cross section, the forming tube having opposite small sides, opposite large sides and a length dimension; first seam-forming means disposed below the forming tube for continuously bonding to one another adjoining longitudinal edges of a web material wrapped about the forming tube and advanced in the length dimension thereof; expander means for spreading apart the opposite sides of the hose below the forming tube; second seam-forming means disposed below said forming tube for providing a transverse seam on said hose to form a bottom terminating in ears; a cutting device disposed below the second seam-forming means for transversely severing the hose; the improvement comprising:

a. a dual clamp disposed below said forming tube and having a first and a second jaw pair adjoining the plane of the one and the other small sides of said forming tube, each jaw pair having an open position and a closed position;

b. means for moving said dual clamp towards and away from said forming tube in the length dimension thereof;

c. means for closing said jaw pairs for grasping said ears and pulling said hose off said forming tube during the movement of the dual clamp away from said forming tube; and d. ear folders disposed externally of said forming tube adjacent each small side of said forming tube, each ear folder being movable with respect to said forming tube for engaging and bending the ears of said hose.

2. An apparatus as defined in claim 1, further comprising a stepping conveyor extending below said forming tube for bringing a container into alignment with said forming tube for introducing the hose portion, bottom first, into the aligned container during the motion of said dual clamp away from said forming tube.

* * * * *